US007021626B2

(12) United States Patent
Butler

(10) Patent No.: US 7,021,626 B2
(45) Date of Patent: Apr. 4, 2006

(54) BOARD GAME

(75) Inventor: Keith A. Butler, Kennesaw, GA (US)

(73) Assignee: Word of Faith Christian Center, Southfield, MI (US)

( * ) Notice: Subject to any disclaimer, the term of this patent is extended or adjusted under 35 U.S.C. 154(b) by 470 days.

(21) Appl. No.: 10/227,755

(22) Filed: Aug. 26, 2002

(65) Prior Publication Data

US 2004/0036215 A1 Feb. 26, 2004

(51) Int. Cl.
*A63F 3/00* (2006.01)

(52) U.S. Cl. ..... 273/243; 273/248

(58) Field of Classification Search ..... 273/243, 273/256, 278, 148
See application file for complete search history.

(56) References Cited

U.S. PATENT DOCUMENTS 4,441,718 A 4/1984 Olson
5,042,816 A 8/1991 Davis et al.
5,071,133 A * 12/1991 Smith ..... 273/248
5,224,862 A 7/1993 Sullivan
5,529,308 A 6/1996 Masakayan
5,533,731 A 7/1996 Koenig
5,803,456 A 9/1998 Lam
5,931,469 A 8/1999 Stichnoth
6,267,375 B1 7/2001 Bernstein et al.
6,425,582 B1 * 7/2002 Rosi ..... 273/243

* cited by examiner

*Primary Examiner*—Vishu K. Mendiratta
(74) *Attorney, Agent, or Firm*—Harness Dickey & Pierce, PLC

(57) ABSTRACT

The Prosperous Touch board game is a game that has been designed to help people gain a full understanding of the keys to walking in financial freedom. It incorporates scriptural teachings found in Proverbs 10:22, Malachi 3:10, 2 Corinthians 9:6–11 and more as well as natural financial principles necessary to walking in financial success. This game can be a great blessing to believers of all ages, as it paints a real life picture of how trust in God and his principles can bring a person to a place of not only spiritual freedom but also financial freedom. It shows that the believer can become fully involved in his God-given call of being Blessed to be a Blessing, to using the abundance God has given him to help spread the good news of the death, burial and resurrection of Jesus.

1 Claim, 3 Drawing Sheets

STEWARDSHIP CARD

Name _____

LAND OF EGYPT

Goal#1: Get out of Debt

| Investments | Debts ($) |
|---|---|
| Savings _____ | |
| Seed _____ | |
| STOCKS: STOCKS / SHARES / PRICE | MORTGAGE _____ |
| | CAR LOAN _____ |
| | CREDIT DEBT _____ |
| | SCHOOL LOAN _____ |
| REAL ESTATE: DOWN / PAY COST | RETAIL DEBT _____ |
| | BANK LOANS _____ |
| | *REAL ESTATE _____ |
| BUSINESSES: DOWN / PAY COST | |
| | *Doesn't count as a debt |

THE WILDERNESS

Goal #2: Work for a giving, not a living — Multiply Monetary Rewards By 2

| Income | Monthly Expenses |
|---|---|
| SALARY _____ | TITHES _____ |
| | TAXES _____ |
| REAL ESTATE (PASSIVE INCOME) _____ | HOUSE NOTE _____ |
| | CAR PAYMENTS _____ |
| | SCHOOL LOANS _____ |
| BUSINESSES (PASSIVE INCOME) _____ | CREDIT CARDS _____ |
| | RETAIL _____ |
| | OTHER EXPENSES _____ |
| | BANK LOANS _____ |
| | CHILD ($140 PER) _____ |

1) Passive Income _____ + Salary _____ = New Income _____

2) New Income _____ - Expenses _____ = Monthly OVERFLOW _____

© 2001 Voice of Faith International Christian Center. Prosperous Touch logo and trademark are property of VOFICC

FIGURE 2

THE PROMISED LAND

Goal #3: Reach 100,000 souls

1. Multiply Passive Income by 50 and receive amount from bank.
2. Multiply Payday by 50
(It is assumed that you have now followed the same natural and spiritual principles for 5-10 years and, therefore, have increased the amount of the anointing to prosper on your life as well as your income).

SEED: _____

BIG PAY DAY: _____
*** Monthly Overflow times 50

| PROJECTS | SOULS WON |
|---|---|
| WORLD BUSINESSES | |

Total Number Won: _____

FIGURE 2a

STEWARDSHIP CARD

Name Believer

LAND OF EGYPT

Goal#1: Get out of Debt

| Investments | | | Debts ($) | |
|---|---|---|---|---|
| Savings | | | | |
| Seed | | | | |
| STOCKS: | STOCKS | SHARES | PRICE | |
| | | | | MORTGAGE -0- |
| | | | | CAR LOAN -0- |
| | | | | CREDIT DEBT -0- |
| | | | | SCHOOL LOAN -0- |
| REAL ESTATE: | DOWN | PAY COST | | RETAIL DEBT -0- |
| | | | | BANK LOANS -0- |
| | | | | *REAL ESTATE -0- |
| BUSINESSES: | DOWN | PAY COST | | |

*Doesn't count as a debt

THE WILDERNESS

Goal #2: Work for a giving, not a living

Multiply Monetary Rewards By 2

| Income | Monthly Expenses | |
|---|---|---|
| SALARY 2,500 | TITHES | 250 |
| | TAXES | 450 |
| REAL ESTATE (PASSIVE INCOME) -0- | HOUSE NOTE | -0- |
| | CAR PAYMENTS | -0- |
| | SCHOOL LOANS | -0- |
| BUSINESSES (PASSIVE INCOME) -0- | CREDIT CARDS | -0- |
| | RETAIL | -0- |
| | OTHER EXPENSES | 300 |
| | BANK LOANS | -0- |
| | CHILD ($140 PER) | -0- |

1) Passive Income -0- + Salary 2,500 = New Income 2,500

2) New Income 2,500 - Expenses 1,000 = Monthly OVERFLOW 1,500

© 2001 Word of Faith International Christian Center. Prosperous Youth logo and trademark are property of WOFICC

FIGURE 3

THE PROMISED LAND

Goal #3: Reach 100,000 souls

1. Multiply Passive Income by 50 and receive amount from bank.
2. Multiply Payday by 50
(It is assumed that you have now followed the same natural and spiritual principles for 5-10 years and, therefore, have increased the amount of the anointing to prosper on your life as well as your income).

SEED: _____

BIG PAY DAY: 200,000
← Monthly Overflow times 50

| PROJECTS | SOULS WON |
|---|---|
| WORLD BUSINESSES | |
| 1. Build new building for church | 10,000 |
| 2. Start Christian cartoon network | 10,000 |
| 3. Invent Christian board game | 5,000 |
| 4. Start Christian movie studio | 100,000 |

Total Number Won: 125,000

FIGURE 3a

BOARD GAME

FIELD OF THE INVENTION

The present invention relates to a board game and, more particularly, to a board game for teaching the biblical and natural principles of personal financial wealth.

BACKGROUND OF THE INVENTION

Numerous board games have been created addressing topics such as investing and financial management generally. For example, U.S. Pat. No. 5,071,135 is entitled "Board Game Apparatus for the Teaching of Financial Management Principles". This patent relates to a board game specifically directed to the accumulation of wealth. U.S. Pat. No. 4,932,668 is entitled "Investment Board Game" and also appears to relate specifically to building net worth. U.S. Pat. No. 5,407,207 is entitled "Board Game Simulating Financial Events of a Lifetime" and generally relates to building financial wealth taking into consideration occurrences which negatively influence one's net worth. While each of these patents relate generally to board games directed to financial management and/or investing, none of the patents consider the aspect of building personal financial wealth taking into account God's master plan as set forth in the Bible.

The Bible is very clear on the subject of financial prosperity. For example, Deuteronomy 8:18 says that it is God who gives the power to get wealth. Proverbs 10:22 says that the blessing of the Lord maketh rich or brings wealth (as one translation states). 2 Corinthians 8:9 shows us that one of the purposes of Jesus' death was so that we could be rich and 2 Corinthians 9:6–11 tells us God's method for causing us to be enriched, which means to be made rich. Careful study of the Bible also reveals that many of the people referenced were wealthy and that God made them so. For example, Abraham was rich, Isaac was rich, Jacob was rich, as was Joseph, Job, David, Solomon, Uzziah and others. All of these, according to scripture, were made wealthy by God. Clearly, it is God's will that his people prosper financially. The purpose of this game is to teach people the Biblical and natural principles necessary to prospering financially God's way. A person can become financially free in this world one of two ways: the world's way or God's way. The world's way brings wealth at the cost of wholeness (peace). God's way brings wealth as a result of wholeness.

Typically, people can be found in one of three financial conditions: in debt, out of debt but still working for a living, or financially free. There are a number of spiritual "ingredients" necessary to the individual who is able to go from being deep in debt to being financially free:

1) You need "the blessing" (Proverbs 10:22), God's power to get wealth. You obtain that blessing by passing God's "obedience test" (Deuteronomy 11:26, 27.

2) You allow God to lead you in making financial decisions (Colossians 3:15). This is generally done through prayer especially when opportunities arise.

3) You become a good steward over the money God has already given you (Luke 16:11).

4) You operate in patience (Hebrews 5:12), especially in regard to receiving your money. Patience is indeed a virtue needed to gain financial freedom.

SUMMARY OF THE INVENTION

According to the invention, a board game and method of playing the board game for teaching the spiritual and natural principles of personal finance and accumulation of wealth is disclosed.

In view of the foregoing, a board game has been developed to teach the above described principles and teachings. The board comprises three distinct sections respectively entitled Egypt, The Wilderness and The Promised Land. Each player begins the game in The Land of Egypt. Prior to starting the game, each player is provided with a Stewardship Card to track their finances throughout the game. The Stewardship Card is configured as a combined Income/Balance Sheet and is set up to apply the basic rules of accounting. The Stewardship Card is updated as a player progresses in the game according to the roll of die. Each player is given the same amount of cash and must fill out their Stewardship Card with the information provided in the rulebook. The Land of Egypt includes spaces, which present unexpected spiritual and financial obstacles and opportunities. By applying Biblical Principles and prudently investing as opportunities arise, a player may obtain enough income to eliminate all personal debts. Once an individual has removed all personal debts, they move on to The Wilderness for further play. In The Wilderness, the player now enjoys life without debts but is also still challenged by financial obstacles and opportunities. Once a player, applying Biblical principles and wise investing, has increased their passive income to a point where it is equal to or has surpassed their monthly expenses, the player moves on to The Promised Land. In The Promised Land, a player gets to enjoy the benefits of having enormous wealth, however, provision is made for unexpected problems and opportunities in various Promised Land spaces along which a player moves. Thus, a player's ongoing financial condition is still carefully updated as the player marches through The Promised Land. The winner of the game is the individual who completes their Stewardship Card which is indicative of making it to The Promised Land and has accomplished the goal of reaching 100,000 souls for The Kingdom of God.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 2 is a plan view of the front side of a Stewardship Card according to the present invention;

FIG. 2*a* is a plan view of the back side of a Stewardship Card according to the present invention;

FIG. 3 is a plan view of the front side of a Stewardship Card shown as being completed by the winner of the game; and FIG. 3*a* is a plan view of the back side of a Stewardship Card shown as being completed by the winner of the game.

DETAILED DESCRIPTION OF THE PREFERRED EMBODIMENTS

Figure 1:
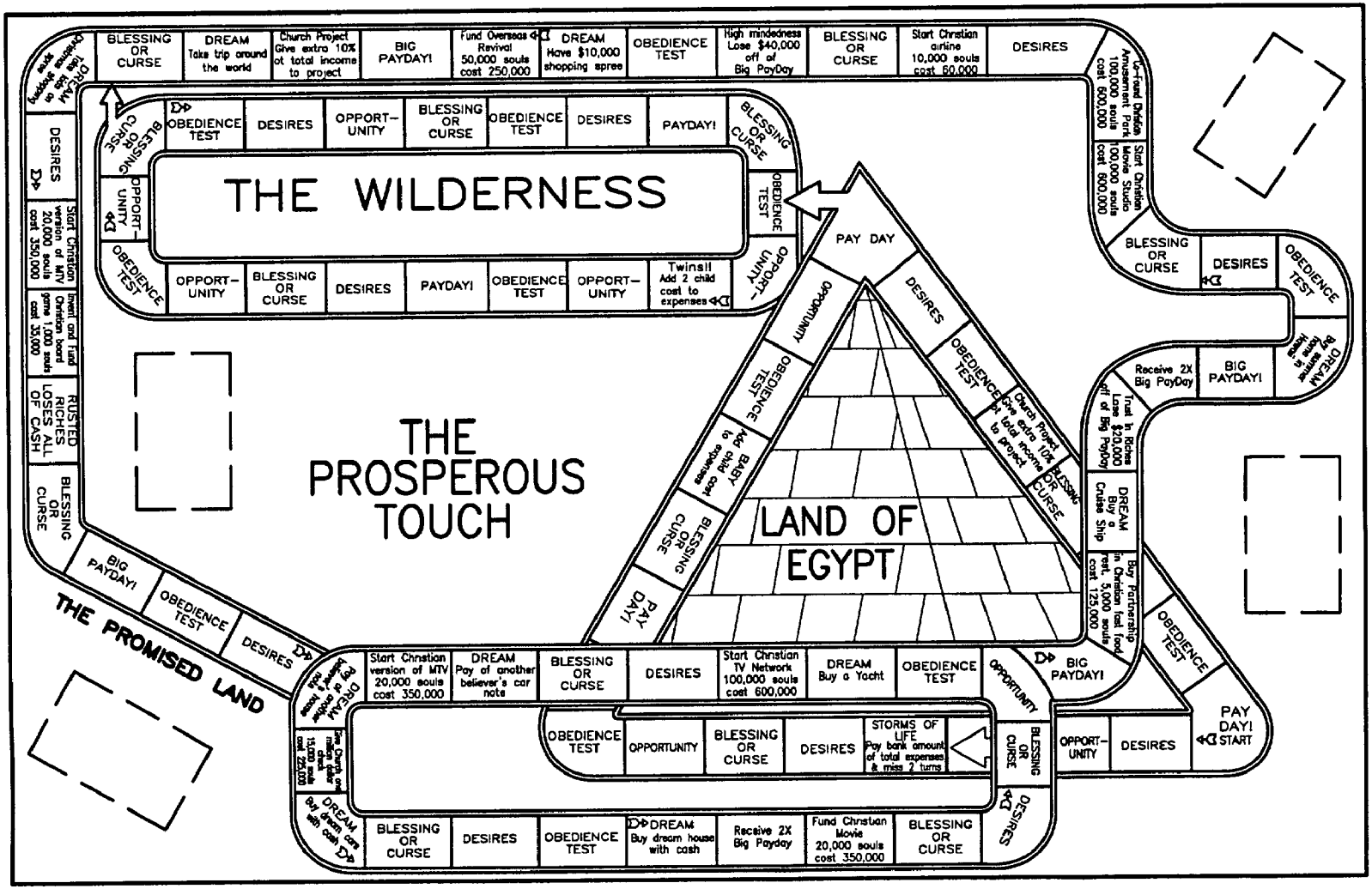
FIG. 1 is a plan view of a board game according to the present invention.

The following description of the preferred embodiment(s) is merely exemplary in nature and is in no way intended to limit the invention, its application, or uses.

Prior to beginning play, ensure that all of the game equipment is present. The game equipment includes:

1) Game Pieces
   including for example, a Cross, a Bible, a Dove, an Angel, a Throne, a Rose, and 5 Curse Pieces;
2) Game Money
   including the denominations of $10, $20, $50, $100, $500. $1,000, $5,000, $10,000, $50,000, $100,000;
3) Stewardship Cards as illustrated in FIGS. 2, 2*a* and 3, 3*a;*
4) Game Board as illustrated in FIG. 1;
5) Dice (2);
6) Game Cards including Blessing or Curse Cards, Desires Cards, Obedience Test Cards and Opportunity Cards.

Game Setup

1) The players elect one player to act as Banker who normally is as a player. The Banker should be someone good with numbers and able to handle cash transactions quickly. The Banker must keep his/her personal money separate from the funds from the Bank. The Banker pays and receives all moneys to and from Players and lends money to players.

2) Separately shuffle the Blessing, Curse, Desires, Obedience and Opportunity cards and place them face down on the game board on their respective marked places.

3) Distribute one Stewardship card as illustrated in FIG. 2 to each player. Also, make sure that each player has a pencil with an eraser.

4) Each player should list on their Stewardship card starting information found in the rulebook.

5) The Banker distributes starting cash (play money) to each player.

The amount of cash each player receives at the beginning of the game is:

a. The player's monthly overflow (income minus expenses on Stewardship card);
b. The player's savings (listed on Stewardship card). Note: savings is only received by a player at the beginning of the game. Savings is not a part of a player's paycheck.

6) Each player pays the bank an offering (the amount of their choosing) which should be recorded as seed on the Stewardship card.

7) All players should have a pencil and a calculator to assist in filling out their Stewardship Card.

Beginning the Game

1) Each Player chooses their game piece.

2) Each Player puts their game piece on the Start here arrow in the land of Egypt.

3) Each Player rolls two dice, and the Player with the highest total count has the first turn. Play then goes on to the left of the starting player.

4) First Player rolls dice and everyone goes around land of Egypt in a clockwise direction.

5) If a player lands on an "Obedience Test", "Desire", "Opportunity", or "Blessing or Curse" space he/she draws the corresponding card. For other places landed on, follow the directions stated in the individual spaces.

Playing the Game

1) Roll 1 die at all times (except for in Promised Land when Player can decide to roll two die versus one at any time).

2) When a Player lands on Payday they receive their Monthly Overflow (income minus expenses on Stewardship Card).

3) All Players start out under "The Blessing" after paying an offering (to be recorded as Seed on Stewardship Card) off of starting money received to the Banker. (Amount to be given as offering chosen by the player involved).

4) After a Player receives his Payday cash he must give an offering to the bank (to be recorded as Seed on Stewardship Card) or be under the Curse until he/she "Repents." (Amount to be given as offering chosen by the player involved).

5) When a Player lands on Obedience Test he/she must either roll die to see if he/she will remain under the Blessing or Curse or in some cases (depending on the card) choose to obey card to stay under the Blessing or not and go under the Curse.

6) When a Player is under "The Curse" he/she must possess the "Curse Piece" as shown in FIG. 5 until he "Repents."

7) When a Player is under "The Curse" he can get back under "The Blessing" by "Repenting". A Player can "Repent" one of three ways:

a. Rolling six;
b. Land on another Obedience Test and pass the test;
c. Use a Free Repent Card (obtained from Obedience Test deck);

8) When a Player lands on The "Blessing or Curse" space he reads and corresponds with whichever one of the two he/she is presently under.

9) When a player draws an "Opportunity Card" he/she must read the card out loud and then chooses whether to invest in stated opportunity or not. Player may sell card to other Players for a price negotiated between players. (Players may not team up with other Players to buy investments).

10) When a player "Sows Seed" then the amount of Seed Sown or offering given is placed under the corresponding space in the investment column on the Stewardship Card. All "offerings" (not tithes), whether given on Paydays or on other Opportunities, count as "Seed Sown."

It should also be noted that when a Player receives a "-fold" return on their seed (ex: 100 fold return) they lose all of the seed listed in their investment column.

11) When a player gains new stock, or property or he/she must fill in corresponding space under investments column or debts column based on the situation.

12) When a player gains new debts or expenses they must fill in the corresponding spaces under the debts and/or expenses column depending on the situation.

13) When a player lands on a "Special Space" (ex: Baby), player must follow instructions written on the space. Under the rules of the game, players are limited to no more than four children.

14) When a Player lands on the "Church Project" space they have the option of giving 10% of their total income amount listed on their Stewardship Card to the bank and to count it as "Seed Sown" or not give the 10% and come under a curse.

15) Anytime a player realizes any type of financial increase through Blessing or Curse Cards (includes tithing off of new house, car, etc.), selling of stocks or any other method that player must give to the bank a tithe of the amount of increase and an offering of their choosing which should be recorded as Seed on Stewardship Card.

16) When there is a change in a player's financial standing, through a salary increase or decrease, acquisition of investments (real estate, businesses), an increase of debts or expenses (ex: having a child or picking up an extra payment), the Player must make the necessary changes in the Income/Expenses, Investment/Debts, Passive Income/Total Income and Overflow spaces on their Stewardship Card. Neighboring players should double-check all calculations.

17) When there is a change in a player's financial standing a Player must make the necessary changes in the Income/Expenses, Investment/Debts, Passive Income/Total Income and Overflow spaces on their Stewardship Card (See Rulebook). Neighboring players should double-check all calculations.

18) Anytime a player realizes any type of financial increase through Blessing or Curse Cards (includes tithing off of new house, car, etc.), selling of stocks or any other method that player must give to the bank a tithe of the amount of increase and an offering of their choosing which should be recorded as Seed on Stewardship Card.

19) Players may borrow from the bank for any reason in increments of $1000 at 10% interest—Player must add $100 to bank loans under expenses column for every $1000 borrowed. Players may not borrow less than $1000 at a time.

20) Bankruptcy Rule: A player is bankrupt and, therefore, out of the game when their Monthly Overflow is negative $500 (–$500).

21) A player may pay off any portion of any debt at any time while in The Land of Egypt, however their expense or monthly payment does not change until they have fully paid off the debt.

22) A player advances out of The Land of Egypt and can enter The Wilderness when they no longer have any debts in the debt column on the Stewardship Card (excluding Real Estate mortgages).

23) When a player is in The Wilderness all monetary rewards from Blessing or Curse cards (excluding "-fold" return) are multiplied by 2.

24) When a Player is in The Wilderness and go back into debt they immediately return to The Land of Egypt and begin at the place labeled start here. Again, the player must extinguish any debts as reflected on their Stewardship card to be eligible to advance back to The Wilderness.

25) A Player advances out of The Wilderness and can enter The Promised Land when their monthly Passive Income is equal to or exceeds their monthly Expenses.

26) When a player moves out of The Wilderness into The Promised Land he/she receives 50 times his/her Passive income. This is done because it is assumed that the individual has followed the same spiritual and natural principles for a number of years and therefore have increased the anointing to prosper on their life and their amount of total income. Also all payday amounts are multiplied by 50 (=BIG PAYDAY).

27) When a player is in The Wilderness and go back into debt they immediately return to The Land of Egypt and begin at the place labeled start here. Again, the player must extinguish any debts as reflected on their Stewardship card to be eligible to advance back to The Wilderness.

28) Again, a player can only get out of The Wilderness and enter The Promised Land when their monthly Passive Income is equal to or exceeds their monthly Expenses.

29) The first person to become financially free and win 100,000 souls to Jesus is the winner.

In The Promised Land, you have the opportunity to purchase "Kingdom Businesses". When you purchase a "Kingdom Business", you win a certain number of souls on the space you have purchased. By purchasing these businesses, the player adds to the number of souls saved.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method of playing a board game comprising:

providing a game board divided into first, second and third sections, each section having defined spaces indicating an instruction to be executed by the player;

providing a plurality of playing pieces, each playing piece being representative of a different player;

providing a supply of simulated money;

providing a plurality of stewardship cards for each player;

rolling at least one die to randomly determine the movement of said playing pieces;

moving said playing pieces sequentially through said first and second sections and then to said third section to be eligible to win said game;

drawing one of a plurality of consequence cards labeled to match spaces on said game board, said consequence cards providing instructions to be followed by the players;

collecting or dispensing said simulated money according to instructions on said consequence cards and said game board; and utilizing a stewardship card to record the relative position of the players during the game such that the first player who completes their stewardship card is declared the winner.

* * * * *